US011386777B2

(12) United States Patent
Gonzalez Aguirre et al.

(10) Patent No.: US 11,386,777 B2
(45) Date of Patent: Jul. 12, 2022

(54) OBSTACLE LOCALIZATION BASED ON PROBABILISTIC CONSENSUS

(71) Applicant: Intel Corporation, Santa Clara, CA (US)

(72) Inventors: David Gonzalez Aguirre, Hillsboro, OR (US); Javier Felip Leon, Hillsboro, OR (US); Rufeng Meng, San Jose, CA (US); Naveen Aerrabotu, Fremont, CA (US); Razia Shaik, San Jose, CA (US)

(73) Assignee: Intel Corporation, Santa Clara, CA (US)

( * ) Notice: Subject to any disclaimer, the term of this patent is extended or adjusted under 35 U.S.C. 154(b) by 550 days.

(21) Appl. No.: 16/237,919

(22) Filed: Jan. 2, 2019

(65) Prior Publication Data

US 2019/0156663 A1 May 23, 2019

(51) Int. Cl.
*G08G 1/01* (2006.01)
*G07C 5/08* (2006.01)

(52) U.S. Cl.
CPC ..... *G08G 1/0141* (2013.01); *G07C 5/0816* (2013.01); *G08G 1/0112* (2013.01); *G08G 1/0116* (2013.01); *G08G 1/0133* (2013.01)

(58) Field of Classification Search
None
See application file for complete search history.

(56) References Cited

U.S. PATENT DOCUMENTS 10,152,834 B1 * 12/2018 Sankavaram ..... G07C 5/0816
2007/0027612 A1 2/2007 Barfoot et al.
2012/0271518 A1* 10/2012 Van Den Broek ..... G08G 1/164 701/48
2013/0022236 A1 1/2013 Chang et al.
(Continued)

FOREIGN PATENT DOCUMENTS

CN 103149940 6/2013
DE 102015202554 B3 * 6/2016 ..... G08G 1/0116

OTHER PUBLICATIONS

Translation of DE-102015202554-B3, Neumann Thorsten, "Method and device for estimating a real traffic condition by means of n sensors," 2016 (Year: 2016).*
(Continued)

*Primary Examiner* — James M McPherson
*Assistant Examiner* — Bakari Underwood
(74) *Attorney, Agent, or Firm* — Schwegman Lundberg & Woessner, P.A.

(57) ABSTRACT

Various systems and methods for updating a current probability density function. The PDF includes a list of objects within a location. First information is received from a first remote device at a first position within the location. The first information includes a vehicle identification, a first PDF of the objects. Second information is received from a second remote device at a second position within the location. The second information includes a vehicle identification, a second PDF of the objects. A first rank for the first PDF is determined based on locations of the objects in the first PDF
(Continued)

compared to locations of the objects in the current PDF. A second rank for the second PDF is determined. The first PDF and the second PDF are combined using the first rank and the second rank into a combined PDF. The current PDF based on the combined PDF.

18 Claims, 4 Drawing Sheets

(56) References Cited

U.S. PATENT DOCUMENTS

| | | | | |
|---|---|---|---|---|
| 2014/0324339 | A1* | 10/2014 | Adam | G01S 13/726 701/519 |
| 2017/0264688 | A1* | 9/2017 | Sell | H04Q 9/00 |
| 2018/0060655 | A1 | 3/2018 | Anastassov et al. | |
| 2018/0352585 | A1 | 12/2018 | Yang et al. | |
| 2019/0156663 | A1 | 5/2019 | Aguirre et al. | |
| 2020/0319297 | A1* | 10/2020 | Bruns | G01S 13/931 |

OTHER PUBLICATIONS

"International Application Serial No. PCT US2019 062800, International Search Report dated Mar. 12, 2020", 3 pgs.
"International Application Serial No. PCT US2019 062800, Written Opinion dated Mar. 12, 2020", 5 pgs.

* cited by examiner

OBSTACLE LOCALIZATION BASED ON PROBABILISTIC CONSENSUS

TECHNICAL FIELD

Embodiments described herein generally relate to combining sensor data from multiple sensors and updating a probability density function of objects within an area.

BACKGROUND

Multi-agent mapping is an active research field with different approaches. However, all of them have to deal with information fusion from different sources at different times. When combining the information, it is important to detect outliers and low-fidelity information that might jeopardize the final result of the fusion. Crowdsourced maps will rely on many autonomous cars from different makers using different sensors that might suffer from with different wear.

BRIEF DESCRIPTION OF THE DRAWINGS

The present disclosure is illustrated by way of example and not limitation in the figures of the accompanying drawings, in which like references indicate similar elements and in which.

Figure 1:
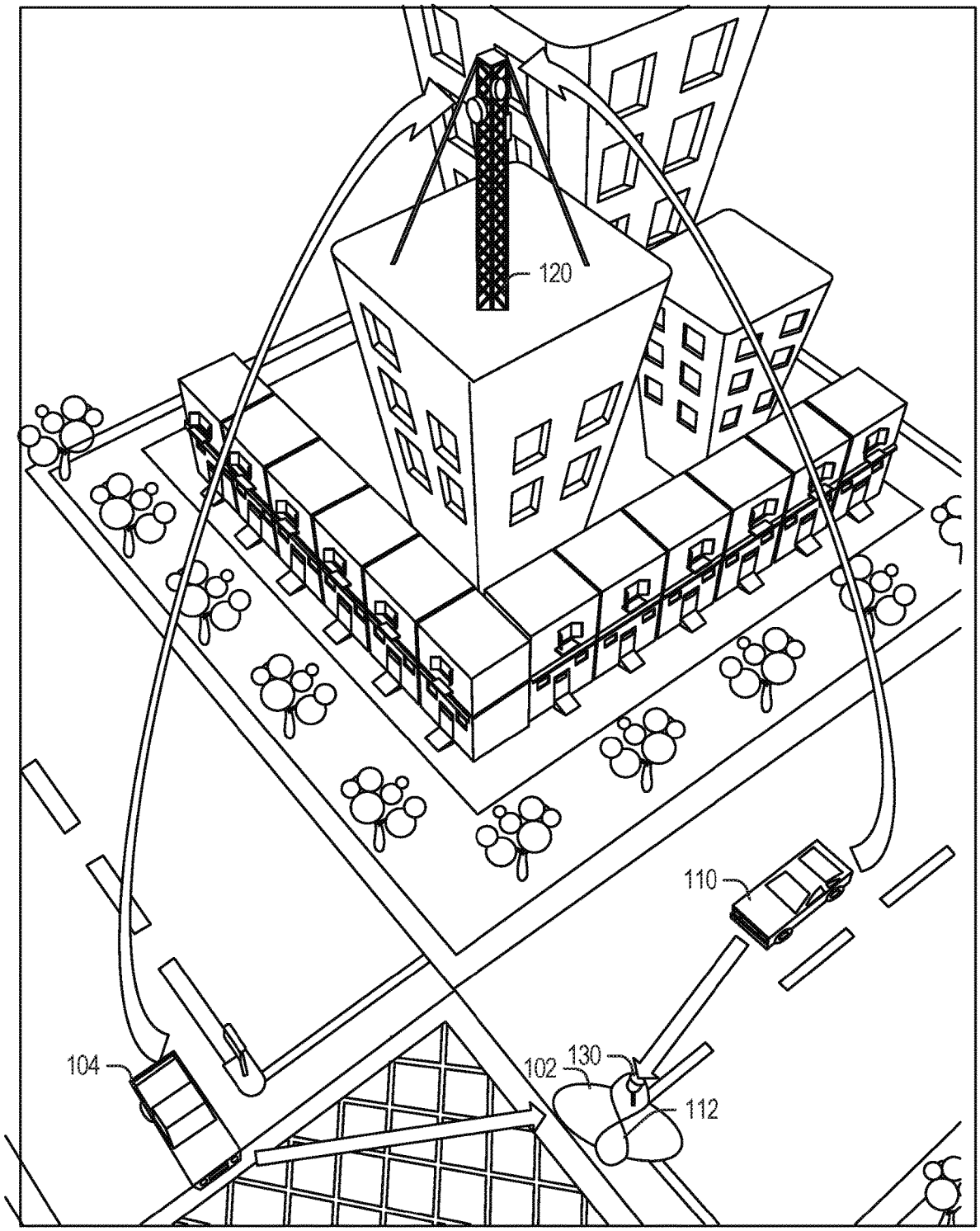
FIG. 1 illustrates a system for updating a probability density function according to some embodiments.

The following description refers to the accompanying drawings. The same reference numbers may be used in different drawings to identify the same or similar elements. In the following description, for purposes of explanation and not limitation, specific details are set forth such as particular structures, architectures, interfaces, techniques, etc. in order to provide a thorough understanding of the various aspects of various embodiments. However, it will be apparent to those skilled in the art having the benefit of the present disclosure that the various aspects of the various embodiments may be practiced in other examples that depart from these specific details. In certain instances, descriptions of well-known devices, circuits, and methods are omitted so as not to obscure the description of the various embodiments with unnecessary detail.

The following description and the drawings sufficiently illustrate specific embodiments to enable those skilled in the art to practice them. Other embodiments may incorporate structural, logical, electrical, process, and other changes. Portions and features of some embodiments may be included in, or substituted for, those of other embodiments. Embodiments set forth in the claims encompass all available equivalents of those claims.

DESCRIPTION

Described herein are various examples that leverage multi-agent localization of objects for updating a map of those objects. In addition, sensor analysis and diagnostics of sensors of the multi-agents may be done. The sensor data and a map of objects, such as a probability density function, may be used to determine a sensor quality or sensor ranking. The ranking may be used to combine the sensor data with the map. In addition, the fusion may simultaneously localize objects, such as static objects, and rank the sensors by quality. The sensor ranking may be used to improve a sensor model for the agent, such as an autonomous vehicle, or to raise an alarm that the sensor is suffering from low quality. The alarm may indicate that the sensor needs to be replaced or fixed.

Vehicles with sensors may send sensor data to an edge device that indicates a position of each static object detected together with its estimated uncertainty (combining vehicle localization uncertainty and sensor measurement uncertainty) and a sensor identifier of the sensor that detected the object. The edge device may maintain a queue, such as a circular queue, per object. Each element of the queue may contain: object location, estimated uncertainty, sensor identifier, and vehicle identifier. The edge device may process each queue and obtain the fused object position and an array of weights that represent the sensor quality. Sensor quality may be used in further computations and may be sent back to each vehicle to improve the model the vehicle has of its own sensors. The sensor quality may be used to trigger service alarms when needed. In various examples, a tiled map may be maintained on the edge by devices located on communications base stations.

FIG. 1 illustrates a system for updating a probability density function according to some embodiments. A vehicle 104 uses onboard sensors to detect an object 130. In an example, the sensors detect the object 130 and provide a probability density function (PDF) 102 for the object 130. The object 130 may have an identifier associated with the object 130. In an example, the identifier may be assigned by the vehicle 104. The vehicle 104 may transmit the PDF and the identifier to a base station 120. The base station 120 may store the PDF of the object 130 in a queue. A vehicle 110 may also detect the object 130 using sensors on the vehicle 110. In an example, the sensors of the vehicle 110 may generate a PDF 112 of the object 130.

The base station 120 may be a static device that includes a communications device with computation and storage capabilities that has coverage over a determined area and transmits and receives information to/from the vehicles, e.g., the vehicles 104 and 110, in its area of coverage. The base station 130 may receive and combine the information from the vehicles 104 and 110 about the environment and update an area map that may be retransmitted to vehicles. Vehicles 104 and 110 may be manned or unmanned with on-board sensors with the capability to detect and localize objects. Vehicles may also have the necessary means to geo-localize themselves using their on-board sensors and report the accuracy of their object and self-localization processes. Vehicles are able to transmit the information about the detected objects with their estimated uncertainty, sensor id and object type to the base station 130.

Figure 2:
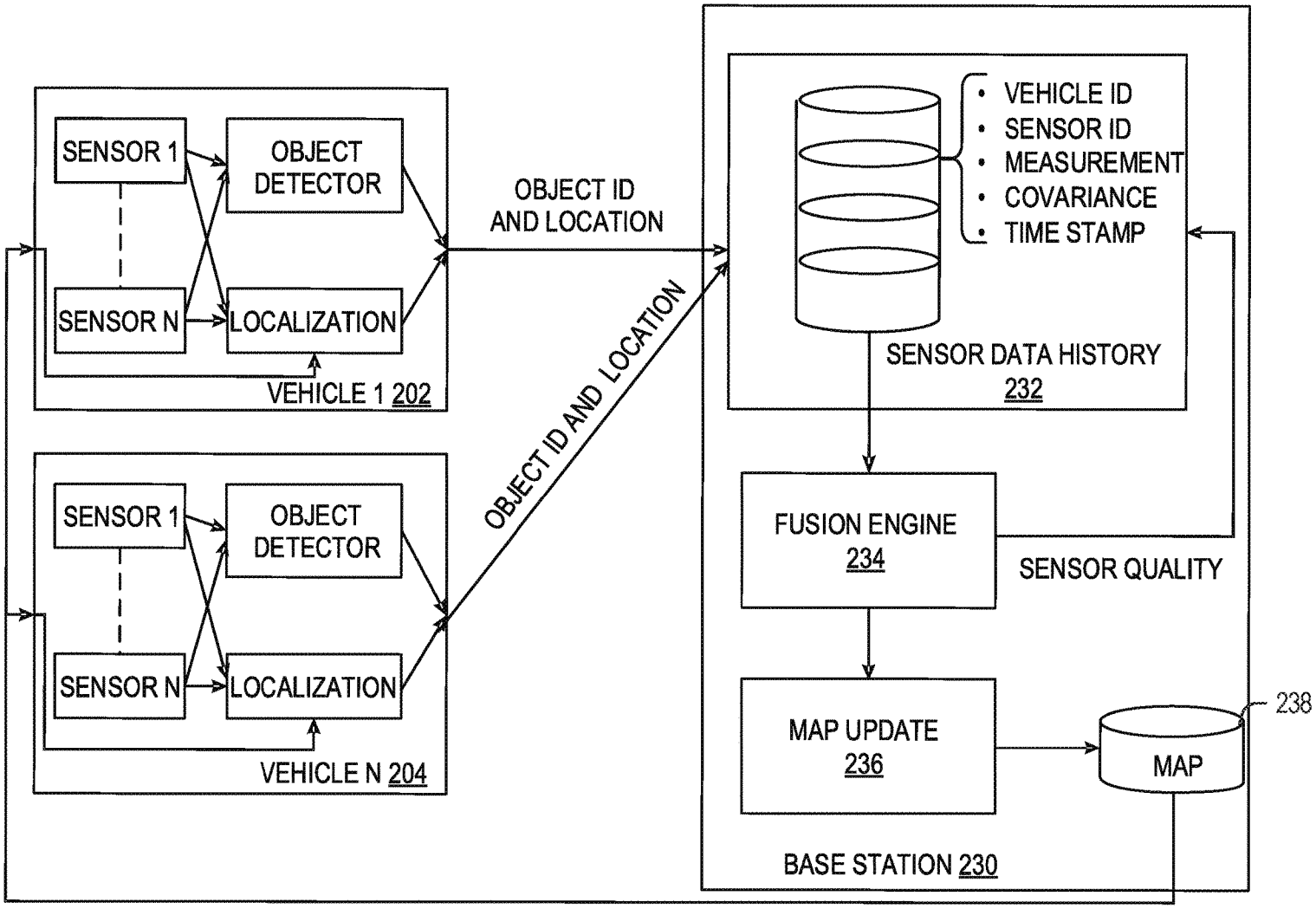
FIG. 2 illustrates a block diagram for updating a probability density function according to some embodiments.

FIG. 2 illustrates a flowchart for updating a probability density function according to some embodiments. A base station 230 maintains object detections in a sensor data history 232 from vehicles 202 and 204. The object detections may be stored in a circular queue of a configurable size that can be tuned depending on the traffic flow, computational capabilities, and experimental results. Each entry in the circular queue contains information about the vehicle that generated the detection, which sensors were used, object id, timestamp, location, and location covariance as a measure of self-localization and object-localization uncertainty.

A fusion engine 234 may be used to fuse together multiple object detections from different vehicles. In an example, the fusion engine 234 may use a maximum a posteriori (MAP) algorithm that is executed to combine the readings in the queue and calculates the object position by weighing the sensor readings based on corresponding prior sensor accuracies. A geographical map update 236 may then be done to update a geographical map 238 of objects that are within an area of the base station 230.

The result of the fusion may include a probability density function (PDF) over the location of the detected objects by the different vehicles, such as the vehicles 202 and 204. The PDF from the fusion engine 234 is combined with the previous PDF of the objects or directly inserted into the map 238 as a new object if there was no previous detection. Therefore, the geographical map consists of a set of object ids and PDF that represent their estimated location.

Accordingly, as shown in FIG. 2 the vehicles 202 and 204 send the detected object identities together with their location and the covariance representing the sensor uncertainty combined with their localization uncertainty. In the base station 230, a mapping device stores the reported detections and combines them in a probabilistic fashion to update the map 238. As a result, the map can be updated with the MAP estimate of the fusion process. Moreover, each detection can be ranked depending on the similarity respect to the MAP estimate. The sensor quality score is stored and used as a prior for future fusion operations where there are detections from the same sensor.

After performing the fusion and the map update, the information in the sensor data history 232 may be used to compute the difference of each measurement and the final MAP estimate of the localized detection. That difference may be used as a sensor quality metric.

From the sensor ranking, the base station 230 may determine the quality of each sensor and identifies the low-performed sensors by pre-defined quality thresholds. The base station 230 may notification to the vehicles which are using those low-performed sensors for maintenance checks or replacement warnings. In an example, the base station 230 may have connections to the traffic administration organism to enforce and monitor autonomous vehicles that rely on sensing for correct operation to maintain road safe.

After a sensor has provided several detections, the system may have a good estimate about the sensor quality and its confidence. However, the first time that a sensor provides a measurement the fusion engine requires a prior distribution in order to perform the MAP estimate. In an example, instead of using a default prior, the prior distribution can be computed as a combination of the manufacturer specifications and other models that take into account the effect of weather, temperature, sensor modality and wear effects due to aging of the sensor.

Figure 3:
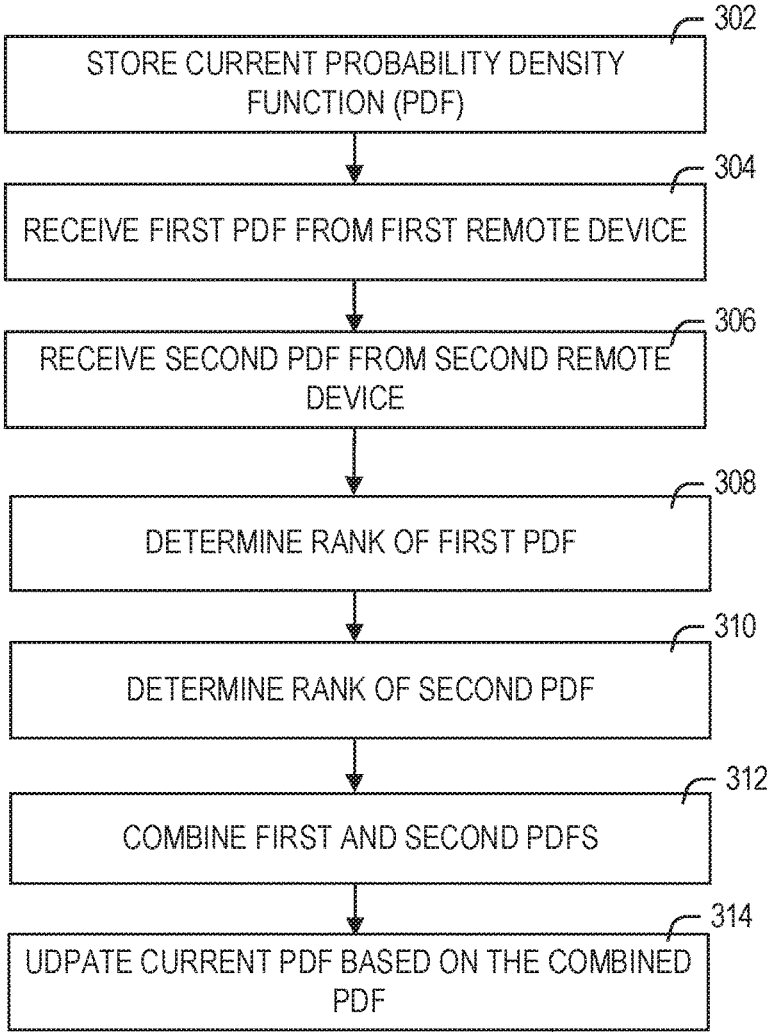
FIG. 3 illustrates a flowchart for updating a probability density function according to some embodiments.

FIG. 3 illustrates a flowchart for updating a probability density function according to some embodiments. At 302, a current PDF of objects within an area of a base station is stored. For the example, the current PDF may be the map 238 from FIG. 2. The area may be an area around the base station 230. At 304, first information from a first remote device is received. The first remote device may be located within the area. The first information includes information about objects detected by the first remote device. Information about each detected object identified may include a PDF of the object and a sensor identification that identifies the sensor used to generate the PDF. The information may also include a vehicle identifier and a timestamp of the detection. At 306, second information from a second remote device is received. The second remote device may be located within the area. The second information includes information about objects detected by the second remote device. Information about each detected object identified may include a PDF of the object and a sensor identification that identifies the sensor used to generate the PDF. The remote devices may be vehicles. The information may also include a vehicle identifier and a timestamp of the detection. The first information and the second information are both received within a time period. The time period may be 1 minute, 5 minutes, 30 minutes, etc.

At 308, a rank for PDF from the first remote device is determined. The rank may be based on locations of the objects in the PDF compared to location of the objects in the current PDF. For example, the closer objects within the PDFs are the higher the ranking for the PDF. At 310, a rank for the PDF from the second remote device is determined. The rank may be based on locations of the objects in the PDF compared to location of the objects in the current PDF. For example, the closer objects within the PDFs are the higher the ranking for the PDF.

At 312, the PDFs from the first remote device and the second remote device are combined into a combined PDF. The PDFs may be combined using the fusion engine 234. In an example, the determined ranks may be used to combine the PDFs. At 314, the current PDF may be updated with the combined PDF. The combined PDF may become more accurate with additional sensor data from various device. More accurate PDFs may be generated even when the individual sensor data includes a margin of error.

The ranks of the PDFs may be also be used to determine a health of the sensor that was used to generate the PDF. For example, a ranking below a predetermined threshold may indicate that the sensor has a large margin of error and should be serviced. Based on the rank of a PDF, an alert may be sent to the corresponding remote device. The alert may indicate that the sensor requires service or replacement. In addition, the rank of the sensor may be indicated in the sensor data history. This rank may be used to ignore future readings from that sensor or to weight the PDF from the remote vehicle accordingly. For example, a low-ranking sensor may have its PDF weighted less compared to other PDFs from more accurate sensors.

The rank of the PDF may also be sent to the corresponding remote device. The remote device may then use the rank of the PDF in its PDF generation. The updated PDF, e.g., the current PDF, may also be sent to the remote devices. A remote device may combine the received updated PDF with a PDF generated from its sensors. In addition, the rank may be used in the combination, such that the PDF generated from the remote device's sensors is weighted based on the rank.

In sonic examples, the information from the remote devices may include a location covariance as a measure of self-localization and object-localization uncertainty. This information may be used in fusing the PDFs together.

Example Machine Description

Figure 4:
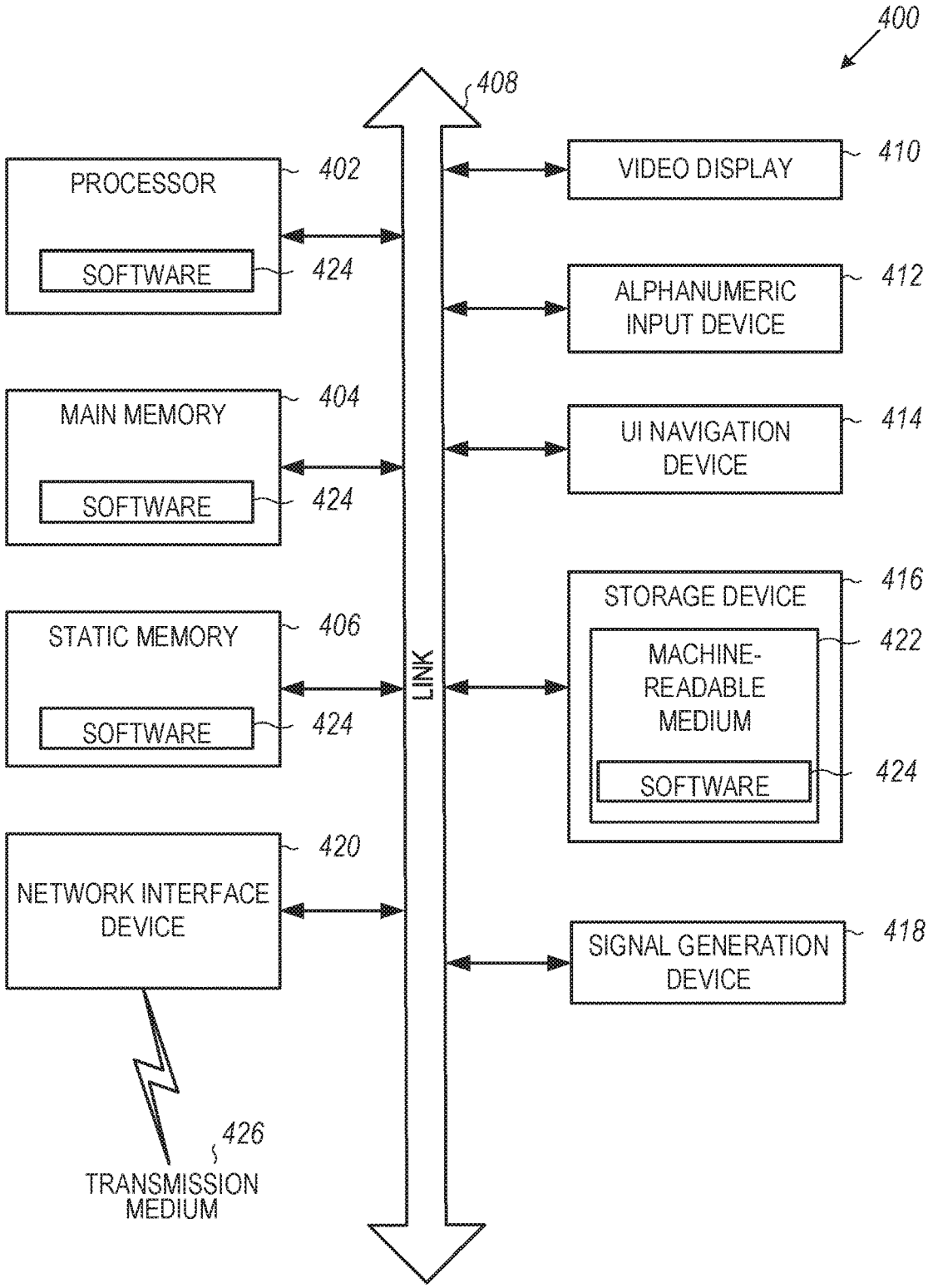
FIG. 4 illustrates a block diagram of a computing device, within which a set or sequence of instructions may be executed to cause the device to perform examples of any one of the methodologies discussed herein.

FIG. 4 illustrates a block diagram of computing device 400, within which a set or sequence of instructions may be executed to cause the device to perform examples of any one of the methodologies discussed herein. In alternative embodiments, the machine 400 may operate as a standalone device or may be connected (e.g., networked) to other machines. In a networked deployment, the machine 400 may operate in the capacity of a server machine, a client machine, or both in server-client network environments. In an example, the machine 400 may act as a peer machine in peer-to-peer (P2P) (or other distributed) network environment. The machine 400 may be a user equipment (UE), evolved Node B (eNB), Wi-Fi access point (AP), Wi-Fi station (STA), personal computer (PC), a tablet PC, a set-top box (STB), a personal digital assistant (PDA), a mobile telephone, a smart phone, a web appliance, a network router, switch or bridge, or any machine capable of executing instructions (sequential or otherwise) that specify actions to be taken by that machine. Further, while only a single machine is illustrated, the term "machine" shall also be taken to include any collection of machines that individually or jointly execute a set (or multiple sets) of instructions to perform any one or more of the methodologies discussed herein, such as cloud computing, software as a service (SaaS), other computer cluster configurations.

Examples, as described herein, may include, or may operate on, logic or a number of components, components, or mechanisms. Modules are tangible entities (e.g., hardware) capable of performing specified operations and may be configured or arranged in a certain manner. In an example, circuits may be arranged (e.g., internally or with respect to external entities such as other circuits) in a specified manner as a component. In an example, the whole or part of one or more computer systems (e.g., a standalone, client or server computer system) or one or more hardware processors may be configured by firmware or software (e.g., instructions, an application portion, or an application) as a module that operates to perform specified operations. In an example, the software may reside on a machine readable medium. In an example, the software, when executed by the underlying hardware of the module, causes the hardware to perform the specified operations.

Accordingly, the term "module" is understood to encompass a tangible entity, be that an entity that is physically constructed, specifically configured (e.g., hardwired), or temporarily (e.g., transitorily) configured (e.g., programmed) to operate in a specified manner or to perform part or all of any operation described herein. Considering examples in which modules are temporarily configured, each of the modules need not be instantiated at any one moment in time. For example, where the modules comprise a general-purpose hardware processor configured using software, the general-purpose hardware processor may be configured as respective different modules at different times. Software may accordingly configure a hardware processor, for example, to constitute a particular module at one instance of time and to constitute a different module at a different instance of time.

Machine (e.g., computer system) 400 may include a hardware processor 402 (e.g., a central processing unit (CPU), a graphics processing unit (GPU), a hardware processor core, or any combination thereof), a main memory 404 and a static memory 406, some or all of which may communicate with each other via an interlink (e.g., bus) 408. The machine 400 may further include a display unit 410, an alphanumeric input device 412 (e.g., a keyboard), and a user interface (UI) navigation device 414 (e.g., a mouse). In an example, the display unit 410, input device 412 and UI navigation device 414 may be a touch screen display. The machine 400 may additionally include a storage device (e.g., drive unit) 416, a signal generation device 418 (e.g., a speaker), a network interface device 420, and one or more sensors, such as a global positioning system (GPS) sensor, compass, accelerometer, or other sensor. The machine 400 may include an output controller 428, such as a serial (e.g., universal serial bus (USB), parallel, or other wired or wireless (e.g., infrared (IR), near field communication (NFC), etc.) connection to communicate or control one or more peripheral devices (e.g., a printer, card reader, etc.).

The storage device 416 may include a machine readable medium 422 on which is stored one or more sets of data structures or instructions 424 (e.g., software) embodying or utilized by any one or more of the techniques or functions described herein. The instructions 424 may also reside, completely or at least partially, within the main memory 404, within static memory 406, or within the hardware processor 402 during execution thereof by the machine 400. In an example, one or any combination of the hardware processor 402, the main memory 404, the static memory 406, or the storage device 416 may constitute machine readable media.

While the machine readable medium 422 is illustrated as a single medium, the term "machine readable medium" may include a single medium or multiple media (e.g., a centralized or distributed database, or associated caches and servers) configured to store the one or more instructions 424.

The term "machine readable medium" may include any medium that is capable of storing, encoding, or carrying instructions for execution by the machine 400 and that cause the machine 400 to perform any one or more of the techniques of the present disclosure, or that is capable of storing, encoding or carrying data structures used by or associated with such instructions. Non-limiting machine readable medium examples may include solid-state memories, and optical and magnetic media. Specific examples of machine readable media may include: non-volatile memory, such as semiconductor memory devices (e.g., Electrically Programmable Read-Only Memory (EPROM), Electrically Erasable Programmable Read-Only Memory (EEPROM)) and flash memory devices; magnetic disks, such as internal hard disks and removable disks; magneto-optical disks; Random Access Memory (RAM); and CD-ROM and DVD-ROM disks. In some examples, machine readable media may include non-transitory machine-readable media. In some examples, machine readable media may include machine readable media that is not a transitory propagating signal.

The instructions 424 may further be transmitted or received over a communications network 426 using a transmission medium via the network interface device 420 utilizing any one of a number of transfer protocols (e.g., frame relay, internet protocol (IP), transmission control protocol (TCP), user datagram protocol (UDP), hypertext transfer protocol (HTTP), etc.). Example communication networks may include a local area network (LAN), a wide area network (WAN), a packet data network (e.g., the Internet), mobile telephone networks (e.g., cellular networks), Plain Old Telephone (POTS) networks, and wireless data networks (e.g., Institute of Electrical and Electronics Engineers (IEEE) 802.11 family of standards known as Wi-Fi®, IEEE 802.16 family of standards known as WiMax®), IEEE 802.15.4 family of standards, a Long Term Evolution (LTE) family of standards, a Universal Mobile Telecommunications System (UMTS) family of standards, peer-to-peer (P2P) networks, among others. In an example, the network interface device 420 may include one or more physical jacks (e.g., Ethernet, coaxial, or phone jacks) or one or more antennas to connect to the communications network 426. In an example, the network interface device 420 may include a plurality of antennas to wirelessly communicate using at least one of single-input multiple-output (SIMO), multiple-input multiple-output (MIMO), or multiple-input single-output (MISO) techniques. In some examples, the network interface device 420 may wirelessly communicate using Multiple User MIMO techniques. The term "transmission medium" shall be taken to include any intangible medium that is capable of storing, encoding or carrying instructions for execution by the machine 400, and includes digital or analog communications signals or other intangible medium to facilitate communication of such software.

Additional examples of the presently described method, system, and device embodiments include the following, non-limiting configurations. Each of the following non-limiting examples may stand on its own or may be combined in any permutation or combination with any one or more of the other examples provided below or throughout the present disclosure.

Example 1 is an apparatus for updating a current probability density function, the apparatus comprising: an electronic processor configured to: store the current probability density function (PDF) of objects within a location; receive first information from a first remote device at a first position within the location, the first information comprising a vehicle identification, a first PDF of the objects within the location and a sensor identification that identifies a first sensor used to generate the first PDF; receive second information from a second remote device at a second position within the location, the second information comprising a vehicle identification, a second PDF of the objects within the location and a sensor identification that identifies a second sensor used to generate the second PDF, wherein the first information and the second information are received within a time period; determine a first rank for the first PDF based on locations of the objects in the first PDF compared to locations of the objects in the current PDF; determine a second rank for the second PDF based on locations of the objects in the second PDF compared to locations of the objects in the current PDF; combine the first PDF and the second PDF using the first rank and the second rank into a combined PDF; and update the current PDF based on the combined PDF.

In Example 2, the subject matter of Example 1 includes, wherein the electronic processor is further configured to: determine the first rank is below a predetermined threshold; and send an alert to the first remote device regarding the first sensor based on the first rank being below the predetermined threshold.

In Example 3, the subject matter of Example 2 includes, wherein the alert indicates the first sensor requires service.

In Example 4, the subject matter of Examples 1-3 includes, wherein the electronic processor is further configured to send the first rank to the first remote device, wherein the first rank is used by the first remote device to generate a PDF of the location.

In Example 5, the subject matter of Example 4 includes, wherein the electronic processor is further configured to send the current PDF to the first remote device, wherein the current PDF is combined with a PDF from the first sensor based on the first rank.

in Example 6, the subject matter of Examples 1-5 includes, wherein the first device is a vehicle.

In Example 7, the subject matter of Examples 1-6 includes, wherein the first information further comprises a location covariance as a measure of self-localization and object-localization uncertainty.

Example 8 is a method for updating a current probability density function, the method comprising operations performed using an electronic processor, the operations comprising: storing the current probability density function (PDF) of objects within a location; receiving first information from a first remote device at a first position within the location, the first information comprising a vehicle identification, a first PDF of the objects within the location and a sensor identification that identifies a first sensor used to generate the first PDF; receiving second information from a second remote device at a second position within the location, the second information comprising a vehicle identification, a second PDF of the objects within the location and a sensor identification that identifies a second sensor used to generate the second PDF, wherein the first information and the second information are received within a time period; determining a first rank for the first PDF based on locations of the objects in the first PDF compared to locations of the objects in the current PDF; determining a second rank for the second PDF based on locations of the objects in the second PDF compared to locations of the objects in the current PDF; combining the first PDF and the second PDF using the first rank and the second rank into a combined PDF; and updating the current PDF based on the combined PDF.

in Example 9, the subject matter of Example 8 includes, wherein the operations further comprise: determining the first rank is below a predetermined threshold; and sending an alert to the first remote device regarding the first sensor based on the first rank being below the predetermined threshold.

In Example 10, the subject matter of Example 9 includes, wherein the alert indicates the first sensor requires service.

In Example 11, the subject matter of Examples 8-10 includes, wherein the operations further comprise sending the first rank to the first remote device, wherein the first rank is used b the first remote device to generate a PDF of the location.

In Example 12, the subject matter of Example 11 includes, wherein the operations further comprise sending the current PDF to the first remote device, wherein the current PDF is combined with a PDF from the first sensor based on the first rank.

In Example 13, the subject matter of Examples 8-12 includes, wherein the first device is a vehicle.

In Example 14, the subject matter of Examples 8-13 includes, wherein the first information further comprises a location covariance as a measure of self-localization and object-localization uncertainty.

Example 15 is at least one computer-readable medium including instructions for updating a current probability density function, the computer-readable medium comprising instructions that, when executed by a machine, cause the machine to perform operations comprising: storing the current probability density function (PDF) of objects within a location; receiving first information from a first remote device at a first position within the location, the first information comprising a vehicle identification, a first PDF of the objects within the location and a sensor identification that identifies a first sensor used to generate the first PDF; receiving second information from a second remote device at a second position within the location, the second information comprising a vehicle identification, a second PDF of the objects within the location and a sensor identification that identifies a second sensor used to generate the second PDF, wherein the first information and the second information are received within a time period; determining a first rank for the first PDF based on locations of the objects in the first PDF compared to locations of the objects in the current PDF; determining a second rank for the second PDF based on locations of the objects in the second PDF compared to locations of the objects in the current PDF; combining the first PDF and the second PDF using the first rank and the second rank into a combined PDF; and updating the current PDF based on the combined PDF.

In Example 16, the subject matter of Example 15 includes, wherein the operations further comprise: determining the first rank is below a predetermined threshold; and sending an alert to the first remote device regarding the first sensor based on the first rank being below the predetermined threshold.

In Example 17, the subject matter of Example 16 includes, wherein the alert indicates the first sensor requires service.

In Example 18, the subject matter of Examples 15-17 includes, wherein the operations further comprise sending the first rank to the first remote device, wherein the first rank is used by the first remote device to generate a PDF of the location.

In Example 19, the subject matter of Example 18 includes, wherein the operations further comprise sending the current PDF to the first remote device, wherein the current PDF is combined with a PDF from the first sensor based on the first rank.

In Example 20, the subject matter of Examples 15-19 includes, wherein the first device is a vehicle.

In Example 21, the subject matter of Examples 15-20 includes, wherein the first information further comprises a location covariance as a measure of self-localization and object-localization uncertainty.

Example 22 is at least one machine-readable medium including instructions that, when executed by processing circuitry, cause the processing circuitry to perform operations to implement of any of Examples 1-21.

Example 23 is an apparatus comprising means to implement of any of Examples 1-21.

Example 24 is a system to implement of any of Examples 1-21.

Example 25 is a method to implement of any of Examples 1-21.

In the above Detailed Description, various features may be grouped together to streamline the disclosure. However, the claims may not set forth every feature disclosed herein as embodiments may feature a subset of said features. Further, embodiments may include fewer features than those disclosed in a particular example. Thus, the following claims are hereby incorporated into the Detailed Description, with a claim standing on its own as a separate embodiment.

What is claimed is:

1. An apparatus for evaluating sensors on remote devices, the apparatus comprising:

a memory device configured to store a current probability density function (PDF) of objects within a location, the current PDF being created from a fusion of prior sensor readings of the objects sensed at the location; and an electronic processor configured to:

receive first information from a first remote device at a first position within the location, the first information comprising a first vehicle identification, a first PDF of the objects within the location and a sensor identification that identifies a first sensor used to generate the first PDF;

receive second information from a second remote device at a second position within the location, the second information comprising a second vehicle identification, a second PDF of the objects within the location and a sensor identification that identifies a second sensor used to generate the second PDF, wherein the first information and the second information are received within a time period;

determine a first rank for the first PDF based on a comparison of locations of the objects in the first PDF to locations of the objects in the current PDF;

determine a second rank for the second PDF based on a comparison of locations of the objects in the second PDF to locations of the objects in the current PDF;

combine the first PDF and the second PDF using the first rank and the second rank into a combined PDF and update the current PDF based on the combined PDF, in response to determining the first rank and the second rank are not below a predetermined threshold; and cause an alert to be transmitted to the first remote device regarding performance of the first sensor based on the first rank being below the predetermined threshold, in response to determining the first rank is below the predetermined threshold and the second rank is not below the predetermined threshold, the alert providing an indication to check or replace the first sensor.

2. The apparatus of claim 1, wherein the alert indicates the first sensor requires service.

3. The apparatus of claim 1, wherein the electronic processor is further configured to send the first rank to the first remote device, wherein the first rank is used by the first remote device to generate a PDF of the location.

4. The apparatus of claim 3, wherein the electronic processor is further configured to send the current PDF to the first remote device, wherein the current PDF is combined with the PDF generated from the first sensor based on the first rank.

5. The apparatus of claim 1, wherein the first remote device is a vehicle.

6. The apparatus of claim 1, wherein the first information further comprises a location covariance as a measure of self-localization and object-localization uncertainty.

7. A method for evaluating sensors on remote devices, the method comprising operations performed using an electronic processor, the operations comprising:

storing a current probability density function (PDF) of objects within a location, the current PDF being created from a fusion of prior sensor readings of the objects sensed at the location;

receiving first information from a first remote device at a first position within the location, the first information comprising a first vehicle identification, a first PDF of the objects within the location and a sensor identification that identifies a first sensor used to generate the first PDF;

receiving second information from a second remote device at a second position within the location, the second information comprising a second vehicle identification, a second PDF of the objects within the location and a sensor identification that identifies a second sensor used to generate the second PDF, wherein the first information and the second information are received within a time period;

determining a first rank for the first PDF based on a comparison of locations of the objects in the first PDF to locations of the objects in the current PDF;

determining a second rank for the second PDF based on a comparison of locations of the objects in the second PDF to locations of the objects in the current PDF;

combining the first PDF and the second PDF using the first rank and the second rank into a combined PDF and updating the current PDF based on the combined PDF, in response to determining the first rank and the second rank are not below a predetermined threshold; and causing an alert to be transmitted to the first remote device regarding performance of the first sensor based on the first rank being below the predetermined threshold, in response to determining the first rank is below the predetermined threshold and the second rank is not below the predetermined threshold, the alert providing an indication to check or replace the first sensor.

8. The method of claim 7, wherein the alert indicates the first sensor requires service.

9. The method of claim 7, wherein the operations further comprise sending the first rank to the first remote device, wherein the first rank is used by the first remote device to generate a PDF of the location.

10. The method of claim 9, wherein the operations further comprise sending the current PDF to the first remote device, wherein the current PDF is combined with the PDF generated from the first sensor based on the first rank.

11. The method of claim 7, wherein the first remote device is a vehicle.

12. The method of claim 7, wherein the first information further comprises a location covariance as a measure of self-localization and object-localization uncertainty.

13. At least one non-transitory computer-readable medium including instructions for evaluating sensors on remote devices, the computer-readable medium comprising instructions that, when executed by a machine, cause the machine to perform operations comprising:

storing a current probability density function (PDF) of objects within a location, the current PDF being created from a fusion of prior sensor readings of the objects sensed at the location;

receiving first information from a first remote device at a first position within the location, the first information comprising a first vehicle identification, a first PDF of the objects within the location and a sensor identification that identifies a first sensor used to generate the first PDF;

receiving second information from a second remote device at a second position within the location, the second information comprising a second vehicle identification, a second PDF of the objects within the location and a sensor identification that identifies a second sensor used to generate the second PDF, wherein the first information and the second information are received within a time period;

determining a first rank for the first PDF based on a comparison of locations of the objects in the first PDF to locations of the objects in the current PDF;

determining a second rank for the second PDF based on a comparison of locations of the objects in the second PDF to locations of the objects in the current PDF;

combining the first PDF and the second PDF using the first rank and the second rank into a combined PDF and updating the current PDF based on the combined PDF, in response to determining the first rank and the second rank are not below a predetermined threshold; and causing an alert to be transmitted to the first remote device regarding performance of the first sensor based on the first rank being below the predetermined threshold, in response to determining the first rank is below the predetermined threshold and the second rank is not below the predetermined threshold, the alert providing an indication to check or replace the first sensor.

14. The at least one non-transitory computer-readable medium of claim 13, wherein the alert indicates the first sensor requires service.

15. The at least one non-transitory computer-readable medium of claim 13, wherein the operations further comprise sending the first rank to the first remote device, wherein the first rank is used by the first remote device to generate a PDF of the location.

16. The at least one non-transitory computer-readable medium of claim 15, wherein the operations further comprise sending the current PDF to the first remote device, wherein the current PDF is combined with the PDF generated from the first sensor based on the first rank.

17. The at least one non-transitory computer-readable medium of claim 13, wherein the first remote device is a vehicle.

18. The at least one non-transitory computer-readable medium of claim 13, wherein the first information further comprises a location covariance as a measure of self-localization and object-localization uncertainty.

* * * * *